United States Patent [19]

Peck

[11] Patent Number: 4,570,606

[45] Date of Patent: Feb. 18, 1986

[54] SHOCK REDUCED BOW

[75] Inventor: Paul L. Peck, Fond du Lac, Wis.

[73] Assignee: Tru Fire Corporation, North Fond du Lac, Wis.

[21] Appl. No.: 559,339

[22] Filed: Dec. 8, 1983

[51] Int. Cl.[4] ..... F41B 5/00

[52] U.S. Cl. ..... 124/24 R

[58] Field of Search ..... 124/23 R, 24 R, 86, 124/90

[56] References Cited

U.S. PATENT DOCUMENTS

| | | | |
|---|---|---|---|
| 695,596 | 3/1902 | Bayard | 124/24 R |
| 982,748 | 1/1911 | Setchell | 124/24 R |
| 1,457,983 | 6/1923 | Malone | 124/24 R |
| 3,518,980 | 7/1970 | Hamm | 124/24 R X |
| 3,993,039 | 11/1976 | Grooes et al. | 124/23 R |
| 4,338,909 | 7/1982 | Plummer | 124/23 R |

*Primary Examiner*—Richard J. Apley
*Assistant Examiner*—William R. Browne
*Attorney, Agent, or Firm*—Bayard H. Michael

[57] ABSTRACT

The archery bow has springs in the string system at each limb of the bow. Due to a high spring rate the springs do not deflect appreciably when the bow is drawn but do deflect substantially when the bow limbs pass the at-rest position after being shot. This allows the limbs to overtravel the at-rest position and be cushioned thereby reducing the shock to the bow and its components.

5 Claims, 3 Drawing Figures

SHOCK REDUCED BOW

FIELD OF THE INVENTION

This invention relates to archery bows and the reduction of shock to the bow.

BACKGROUND OF THE INVENTION

When a bow is drawn great forces are built up. When the arrow is released, these forces accelerate the arrow as the bow returns to its normal position. On reaching that position the limbs are at maximum speed. . . and everything comes to an abrupt halt causing considerable shock to the bow which shortens the life of the bow and its components. This typically leading to breaking the limbs, cables or strings. This is true of all bows.

SUMMARY OF THE INVENTION

The object of this invention is to reduce the shock to components of a bow after the arrow has been cast (shot). This is accomplished by providing a spring between the bow and bow string. The spring has enough force to not extend (or compress) as the bow is drawn or released, but to extend (compress) after the arrow has been cast. Put another way, the spring does not deflect even at full draw (maximum force in the string) but will deflect after the arrow has been cast. Thus, the spring permits the bow to overtravel the normal at-rest position to reduce the shock to the bow. Preferably, a spring is provided between each limb and the cable or at the string ends.

While the illustrated bow uses cable and a bow string, some bows only use a string. Therefore, the claims use the term bow string system to embrace either approach. The springs can be located as shown or at the connection between the cable ends and the string or conceivably could be located in the limb mounting. All these approches result in a spring system allowing overtravel of the at-rest position of the limbs after the arrow has been cast. This overtravel against the spring force reduces shock to the bow and its components.

DETAILED DESCRIPTION OF THE DRAWINGS

Figure 1:
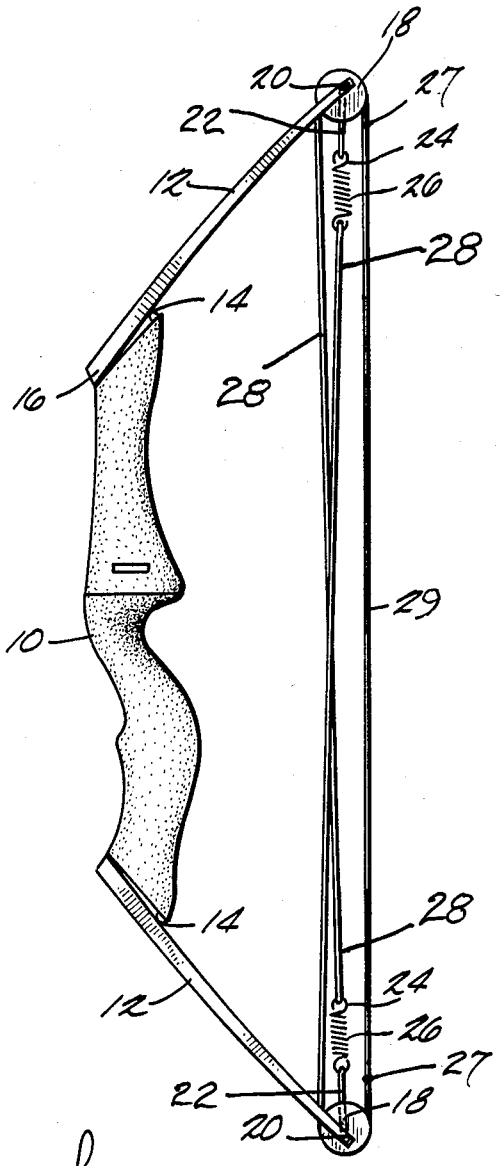
FIG. 1 is a side elevation of a compound bow equipped with the present invention.

The compound bow shown in FIG. 1 is illustrative of a bow in the sense that the present invention is applicable to a recurve bow or, for that matter, the old style long bow. All bows go through a tremendous shock at the end of the release, that is, after the arrow has been cast. All archers experience the shock delivered to the hand holding the bow after the arrow has been cast. It is easy to visualize the forces involved when it is realized that the tension in a bow string is far greater than the force required to deflect that bow string, i.e., the draw strength of the bow. Now when the arrow has been drawn and released the stored force is delivered to accelerating the arrow and driving the bow back to its original position. When the bow reaches its original position, the bow string is tight across the ends and all motion comes to an abrupt halt (the string stretches somewhat but the shock to the bow is great).

In the compound bow in FIG. 1, the rigid riser section 10 has a limb 12 pivoted on pivot 14 at each end of the riser and adjustably restrained by a cable between the end 16 and the riser. At the free end of each limb there is a wheel 18 mounted on a shaft 20. The wheels provide an eccentric action. The cable 22 is connected to the pivot 20 and would normally be reeved around an opposed wheel and then would be connected to the bow string. In the present case, however, the cable 22 is provided with an end which is connected to the hooked end 24 of tension spring 26. The other hooked end 24 of the spring is connected to the cable 28 which is reeved on the opposed wheel in the conventional way with each end of the cable connected to string 29 at 27. Thus, there is a spring 26 in the string system on each side of the nocking point (midpoint) of the string 29. The spring can be anywhere but is preferably where shown or at 27 where the cable and string join.

In the at-rest or normal position illustrated in FIG. 1, the coils of the spring are essentially stacked, i.e., the spring has not been extended at all. As the bow is drawn, the springs will not extend any appreciable amount if at all. They are stronger than the tension in the system. However, after the arrow is released and cast the bow comes back to the position illustrated; but now it is a dynamic situation and the tension is far greater and will temporarily extend the tension springs to permit the limbs to slightly overtravel the at-rest position. This overtravel is in addition to stretch of the string.

This overtravel greatly reduces the shock to the bow and its components (the limbs, riser and any bow sights and the like). The reduction is easily felt by the archer and is easily heard by the archer. There is much less noise in the bow coming to a halt, particularly when the bow is "dry fired" which is a classic way to damage a bow due to the tremendous forces being delivered back to the bow (since none of the force has been expended in accelerating and casting the arrow).

Figure 2:
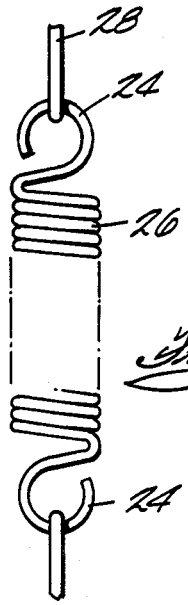
FIG. 2 is a detail view of a tension spring of the type shown in FIG. 1.
Figure 3:
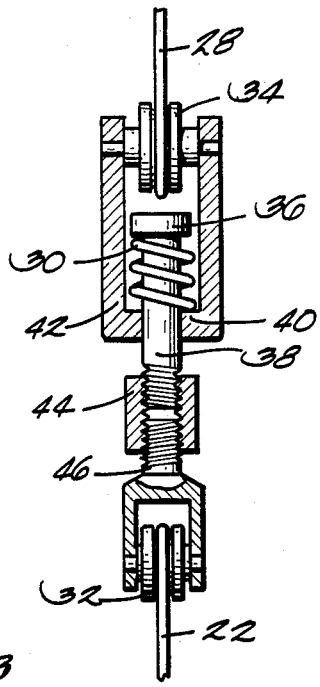
FIG. 3 is an alternate design showing a compression spring arrangement.

In FIG. 3 there is a system shown whereby a compression spring 30 is used in lieu of the tension spring in FIGS. 1 and 2. Here one end of the cable is connected to the roller 32, while the other cable end is connected to roller 34. The rollers do not roll; they simply provide a larger turning radius for the cable. The spring 30 is compressed between the head 36 on pin 38 and the inturned shoulder 40 in the spring housing 42. The other end of the pin 38 is threaded into the adjustment nut 44 which also has pin 46 threaded into it, the threads being opposed pitches so that the nut 44 can be turned to bring the ends of 38 and 46 closer or further apart to adjust the length of the cable. This is simply an extra feature which does not affect the shock absorption of the system. The obvious drawback of the FIG. 3 embodiment lies in cost and added weight. Any weight at the tip of the limb is to be avoided if possible. Therefore, the simple tension spring of FIGS. 1 and 2 are preferred.

The coiled spring could be replaced by a rubber (elastomeric) member having cable hooks molded in each end. The coiled spring is thought more attractive than the rubber spring.

I claim:

1. An archery bow having bow limbs and including, a bow string system including a bow string, and spring means in said system allowing said bow limbs to ovetravel the at-rest position after an arrow has been cast, said spring means having a spring rate requiring more force to deflect said spring means than the tension in the bow string at full draw of the bow with the result that the spring means does not deflect appreciably when the bow is drawn but does deflect a substantial amount as the limbs pass their at-rest position following the release of said bow string system at full draw.

2. An archery bow according to claim 1 in which spring means is provided between each limb and the bow string system.

3. An archery bow according to claim 2 in which the spring means comprises a tension spring which elongates when it is deflected.

4. An archery bow according to claim 2 in which the spring means is a spring which compresses during deflection of the spring.

5. An archery bow according to claim 1 in which the spring means includes a spring between the nocking point and each limb of the bow.

* * * * *